United States Patent [19]

Tanaka et al.

[11] Patent Number: 4,715,437

[45] Date of Patent: Dec. 29, 1987

[54] HEAT EXCHANGER

[75] Inventors: Hiroyoshi Tanaka, Kyoto; Masaaki Adachi, Nara; Yoshiyuki Tsuda, Suita; Toshiaki Ando, Yawata; Humitoshi Nishiwaki, Nishinomiya; Shigeo Aoyama, Higashiosaka, all of Japan

[73] Assignee: Matsushita Electric Industrial Co. Ltd., Osaka, Japan

[21] Appl. No.: 851,507

[22] Filed: Apr. 14, 1986

[30] Foreign Application Priority Data

Apr. 19, 1985 [JP] Japan ..... 60-83833
May 24, 1985 [JP] Japan ..... 60-112445

[51] Int. Cl.[4] ..... F28D 1/04
[52] U.S. Cl. ..... 165/151
[58] Field of Search ..... 165/151, 152

[56] References Cited

U.S. PATENT DOCUMENTS 1,739,672 12/1924 Higgin ..... 165/151

FOREIGN PATENT DOCUMENTS 48006 6/1980 Japan ..... 165/151

*Primary Examiner*—Albert W. Davis, Jr.
*Assistant Examiner*—Peggy Neils
*Attorney, Agent, or Firm*—Stevens, Davis, Miller & Mosher

[57] ABSTRACT

Disclosed is a heat exchanger having a plurality of flat fins disposed in parallel at predetermined intervals and adapted such that the air flows therebetween and a plurality of heat-transfer tubes disposed to intersect at right angles with the plurality of fins and adapted such that a fluid flows therethrough. The heat-transfer tubes are arranged such that a line connecting the adjacent heat-transfer tubes in the longitudinal direction of the fin is perpendicular to the direction of the air flow. The projection area in the direction of the air flow of any of the heat-transfer tubes located on the upstream side with respect to the air flow partially overlaps the position of at least one of the heat-transfer tubes disposed on the downstream side thereof. The pitch of adjacent heat-transfer tubes is smaller in the direction perpendicular to the air flow than in the direction of the air flow. Such an arrangement excells in both the frosting characteristics and performance.

2 Claims, 18 Drawing Figures

HEAT EXCHANGER

BACKGROUND OF THE INVENTION

1. Field of the Invention

The present invention relates to a heat exchanger used in air-conditioning, refrigeration or the like and adapted to transmit heat between fluids such as a refigerant and air.

2. Prior Art

This type of heat exchanger illustrated schematically in FIG. 1 generally has copper tubes 1 connected to each other by means of U-bends as well as fins 2 made of aluminum and is arranged such that a refrigerant flowing through the copper tubes 1 and air 3 flowing through the fins 2 effect heat exchange. In recent years, there has been a demand for such types of heat exchanger to be made compact and to be provided with high performance. However, since the speed of air flow between adjacent fins is checked to a low level with a view to reducing noise and for other reasons, the air flowing outside the tube experiences a greater heat resistance than the refrigerant flowing inside the tube. Therefore, a common measure which is currently taken is to expand the air-side heat area, thereby reducing the difference in heat resistance between the air-side and refrigerant-side tube surfaces. However, an attempt to expand the heat area encounters certain physical limitations, and there are also problems in terms of economic efficiency, the need for saving space, etc. Therefore, the achievement of a reduction in air-side heat resistance in such a heat exchanger has been regarded as an important task. In addition, heat exchangers provided with slits, louvers or the like on the fin surfaces thereof have come into use in recent years. However, if such a heat exchanger is used for an outboard heat pump unit, frosting occurs during winter to a remarkable degree, so that it becomes necessary to effect defrosting more frequently than in the case of a heat exchanger employing flat fins. For this reason, a room temperature may change to a remarkable extent to the discomfort of occupants. In terms of economic efficiency as well, the seasonal efficiency in winter resulting from energy loss during the changeover to the defrosting mode suffers decline with these types of heat exchangers. Consequently, fins provided with slits, louvers or the like are employed for the inboard unit of a heat-pump cooling and heating machine, while flat fins are used for the heat unit of the outboard unit. In cases where flat fins are used, the outboard unit becomes large in size, resulting in increased production costs, so that there has been a demand for some improvement in this respect.

FIGS. 2*a* and 2*b* show an example of a conventional heat exchanger which does not have slits. FIG. 2*a* is a top plan view, while FIG. 2*b* is a side elevational view. A refrigerant such as Freon circulates through copper tubes 4, and the heat of the refrigerant is transmitted from the copper tubes 4 to fin collars 5 and then to fins 6. The air 7 flows backward from the front of the fins 6 and passes between the adjacent fins 6. At that time, heat is exchanged between the air coming into contact with the fins 6 and the surfaces of the fins 6 which have a different temperature and to which heat is transmitted from the refrigerant. Owing to this action, heat exchange between the refrigerant and the air is carried out continuously.

Such a fin is poor in terms of performance but excels in terms of frosting characteristics, namely, any decline in its performance resulting from frosting is low. For this reason, such fins are used for the outboard unit of a heat pump cooling and heating machine. However, if comparison is made between a heat exchanger constructed with such flat fins and a heat exchanger provided with slits, louvers or the like, the former has a disadvantage in that the weight or volume per unit capacity becomes extremely large since the performance thereof is poor. For this reason, various measures have been proposed to improve the frosting characteristics, but it has been difficult to find an arrangement of fins in which both the frosting characteristics and performance excel at the same time.

Meanwhile, FIGS. 3*a* and 3*b* show an example of a conventional heat exchanger having cutouts. FIG. 3*a* is a top plan view, while FIG. 3*b* is a cross sectional view taken along the line IIIa–IIIb of FIG. 3*a*. A refrigerant such as Freon circulates through copper tubes 5, and its heat is transmitted from the copper tubes 5 to fin collars 6, and then to fins 7 and cutouts 8. Meanwhile, the air sent in the direction of an arrow 9 by means of a fan passes between the adjacent fins 7, and, at that juncture, transmits heat to the fin surfaces having a different temperature or absorbs heat from the same.

The heat exchanger of this conventional type is called a slit-fin type having the cutouts 8 in each fin 7. If such a fin is compared experimentally with a flat fin which is not provided with slits or the like, the former exhibits surface heat resistance reduced by 40 to 50% compared with the latter. Theoretically, however, if cutouts are thus provided on the fin surface, since the heat transfer coefficient of the laminar flow in the entrance region becomes extremely high, it should be possible for the heat resistance coefficient of the fin surface to be lowered by 50% or more. The difference between this theoretical value and the experimental value can be accounted for by various factors, the major of which may be cited as follows: (1) the pressure loss of the air flow passing the cutouts 8 is higher than the other portion, so that the amount of air passing through the cutouts 8 declines, and sufficient use is thus not made of the thermal performance. (2) Since a large dead water region exists, the effective heat transfer area is reduced. Since the dead water region downstream of each copper tube 5 located on the upstream side of the air flow 9 covers the cutouts 8 located therebehind, the heat resistance of these cutouts 8 increases, thereby increasing the average heat resistance of the fins. (3) Since the copper tubes 5 are disposed in a staggered manner and the cutouts 8 are provided in front of or at the rear of the copper tubes 5, the heat flux from the copper tubes 5 is prevented, resulting in a decline in fin efficiency.

However, because a fin provided with slits has an adequate performance unlike a flat fin, heat exchangers having such an arrangement have been used as the inboard unit of a heat-pump cooling and heating machine, or as a unit exclusively used for cooling. The reason for this is that a fin having such slits has poor frosting characteristics despite the fact that its overall performance is high.

Through measures for rearranging the positional relationship between the fins and the heat transfer tubes, the present invention provides an arrangement of fins having cutout which has an unprecedentedly high performance and which experiences less frosting, as well as an arrangement of fins which has extremely good frosting characteristics and a high performance.

SUMMARY OF THE INVENTION

Accordingly, an object of the present invention is to provide a compact and high-performance heat exchangers with fins, wherein (1) the air flow between adjacent heat-transfer tubes is made uniform so as to prevent the amount of air passing through a cutout from decreasing and to realize entrance region flow between parallel flat plates, thereby obtaining a heat transfer rate close to a theoretical value, (2) the air flow is induced by utilizing a phenomenon of adhesion of a fluid to a dead water region, thereby reducing the area of the dead water region, and (3) an arrangement of heat-transfer tubes and heat-transfer surfaces which does not impede the heat flux between adjacent heat-transfer tubes, thereby overcoming the aforementioned drawbacks of the prior art.

To this end, the present invention provides a heat exchanger having a plurality of flat fins disposed in parallel at predetermined intervals and adapted such that the air flows therebetween and a plurality of heat-transfer tubes disposed such as to intersect at right angles with the plurality of fins and adapted such that a fluid flows therethrough, characterized in that the heat-transfer tubes are arranged in such a manner that a line connecting the adjacent heat-transfer tubes in the longitudinal direction of the fin is perpendicular to the direction of the air flow, the projection area in the direction of the air flow of any of the heat-transfer tubes located on the upstream side with respect to the air flow partially overlaps the position of at least one of the heat-transfer tubes disposed on the downstream side thereof, and the interval between the adjacent heat-transfer tubes is larger in the direction perpendicular to the air flow than in the direction of the air flow.

Other objects and advantages of the invention will become more apparent from the following description of the preferred embodiments when the same is read in conjunction with the accompanying drawings.

DESCRIPTION OF THE PREFERRED EMBODIMENTS

Figure 1:
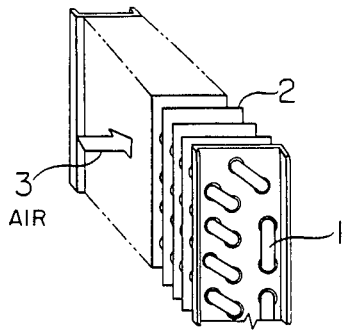
FIG. 1 is a perspective view of a conventional heat exchanger.
Figure 2A:
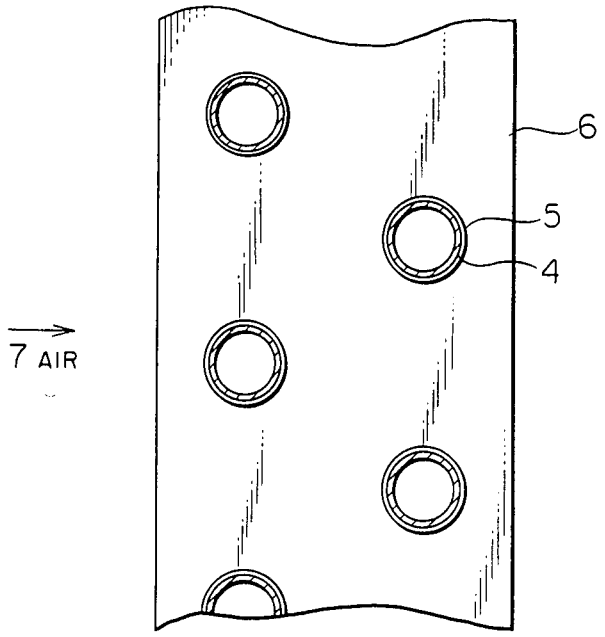
FIGS. 2*a* and 2*b* schematically illustrate a conventional flat fin-type heat exchanger.
Figure 2B:
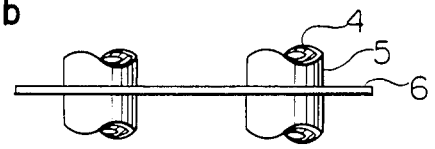
Figure 3A:
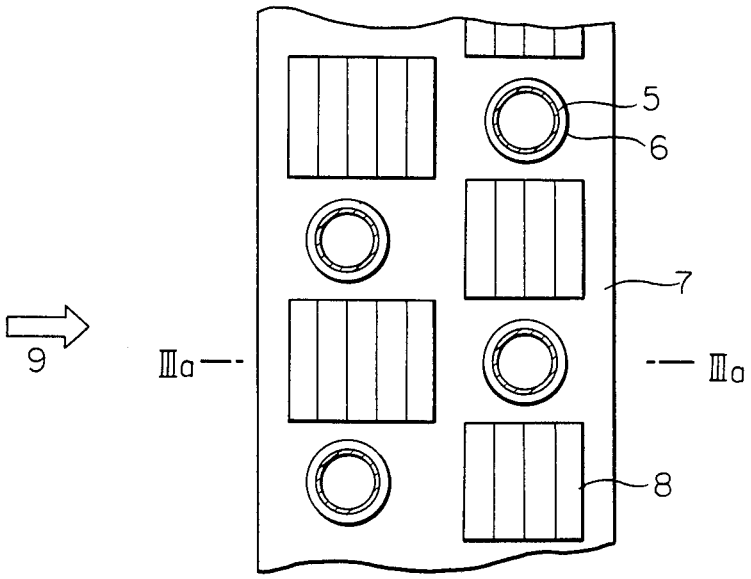
FIGS. 3*a* and 3*b* schematically illustrate a conventional cutout, namely slit fin-type heat exchanger.
Figure 3B:
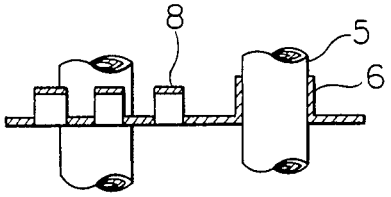
Figure 4A:
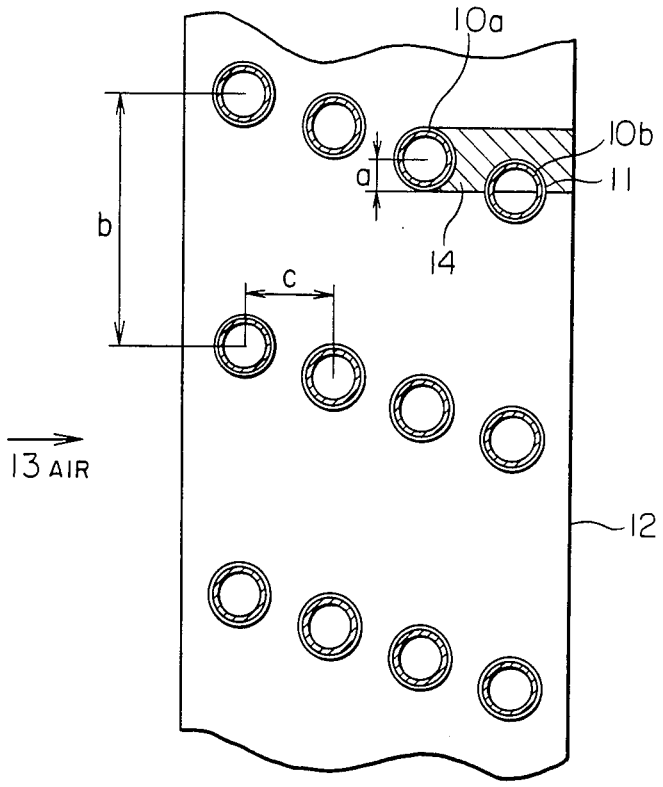
FIGS. 4*a*, 4*b*, 5*a*, 5*b*, 6*a*, 6*b*, 7*a*, and 7*b* schematically illustrate the embodiments of a heat exchanger according to the present invention which are not provided with cutouts.
Figure 4B:
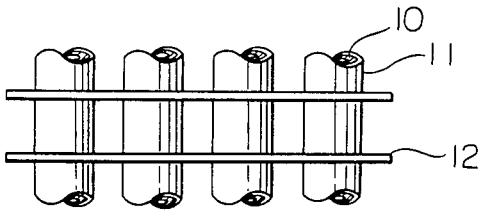
Figure 8:
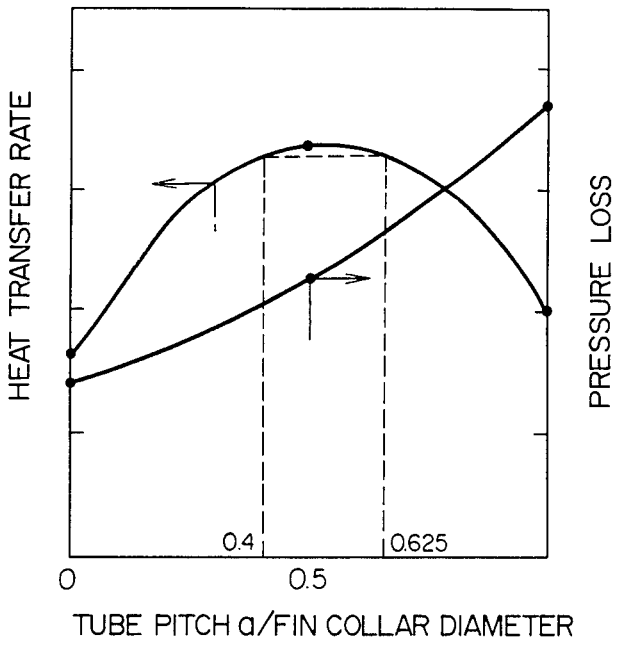
FIG. 8 is a chart showing the operation of a heat exchanger according to the present invention.

Description of an embodiment of the present invention will be made hereinafter with reference to the accompanying drawings. FIGS. 4*a* and 4*b* illustrate an embodiment of a heat exchanger according to the present invention, in which FIG. 4*a* is top plan view, while FIG. 4*b* is a side elevational view. Reference numerals 10*a*, 10*b* denote copper tubes, through which a refrigerant circulates. The heat of the refrigerant is transmitted from the copper tubes 10 to fin collars 11, and then to fins 12, thereby exchanging heat with the air 13 flowing from the front of the fins 12. The copper tubes 10 are arranged such that, as can be seen from the relationship between the copper tubes 10*a* and 10*b*, the projection area 14 of the upstream-side copper tube 10*a* partially overlaps the position of the copper tube 10*b*, and the pitch b of the groups of copper tubes is set to be greater than the pitch c of the adjacent copper tubes. In other words, the copper tubes 10 are arranged in such a manner that the projection area of any of the upstream-side copper tubes 10 partially overlaps the position of a downstream-side copper tube. The relationship among the tube pitch a of this pair of copper tubes, the heat transfer rate, and the pressure loss is shown in FIG. 8. Since the pressure loss increases is b/c becomes small, b and c in this embodiment are set so that $b>c$ is established. Meanwhile, the heat transfer rate becomes maximum when the tube pitch a is one-half or thereabout of the fin collar diameter. Although, in this embodiment, the tube pitch a is set to be one-half of the fin collar diameter, it is possible to expect a substantially equivalent if the pitch a is set in the vicinity of two-fifths to five-eighths of the fin collar diameter. The pressure loss in this case is smaller than in the case of a staggered arrangement. In addition, since the groups of copper tubes according to this embodiment are arranged in such a manner as to be located diagonally with respect to the air flow, this arrangement allows a greater tube pitch than in the case of a checkerboard arrangement, thereby facilitating condensate to drop off easily. Furthermore, although dead water regions appear in the entire regions downstream of each copper tube if the checkerboard arrangement is adopted, the area of each dead water region decreases substantially in the case of such a copper tube arrangement as the one adopted in as this embodiment.

However, the advantages of the present invention are confined to fin-type heat exchangers such as the one shown in the embodiment, and sufficient advantages cannot be obtained in the case of heat exchangers comprised of only tubes without employing fins.

Figure 5A:
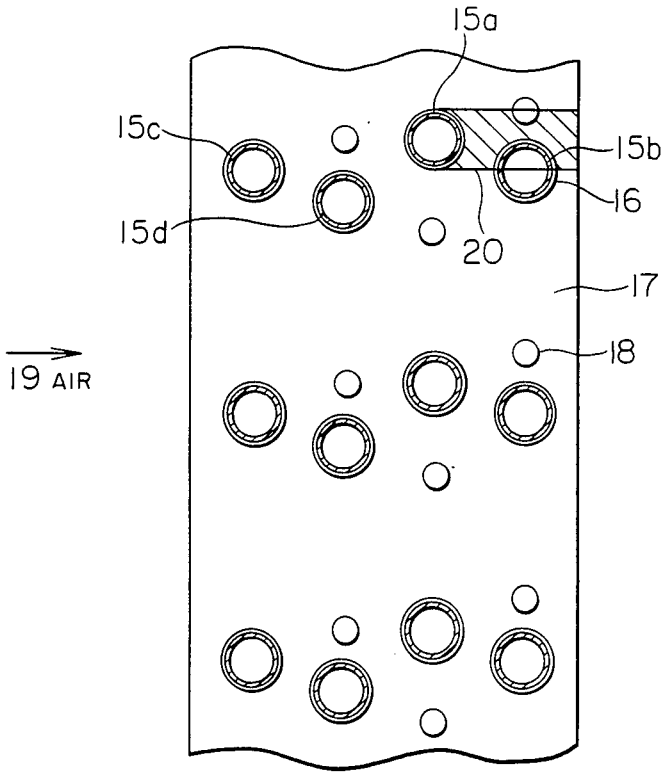
Figure 5B:
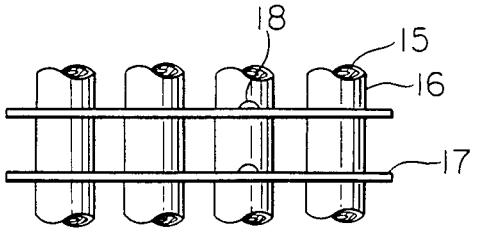

FIGS. 5*a* and 5*b* illustrate another embodiment of the present invention, in which FIG. 5*a* is a top plan view, while FIG. 5*b* is a side elevational view. The advantages of this embodiment are substantially the same as those of the embodiment of the present invention illustrated in FIGS. 4*a* and 4*b*, but differences lie in the arrangement of copper tubes 15 and in the presence of hemispherical protrusion. The projection area 20 of a copper tube 15*a* partially overlaps the position of a copper tube 15*b*. In addition, a hemispherical protrusion 18 provided on a fin 17 is also arranged to partially overlap the projection area of a copper tube. Since such projections 18 are provided, each horseshoe eddy generated due to the presence of an upstream-side tube and fins enters the region a group of copper tubes comprised of copper tubes 15*a*, 15*b*, 15*c*, and 15*d*. As a result, heat transfer in the region of a group of copper tubes can be improved substantially. At the same, since the air flows even to the rear portion of each copper tube, the area of each dead water region becomes small, thereby increasing an effective heat transfer area.

Figure 6A:
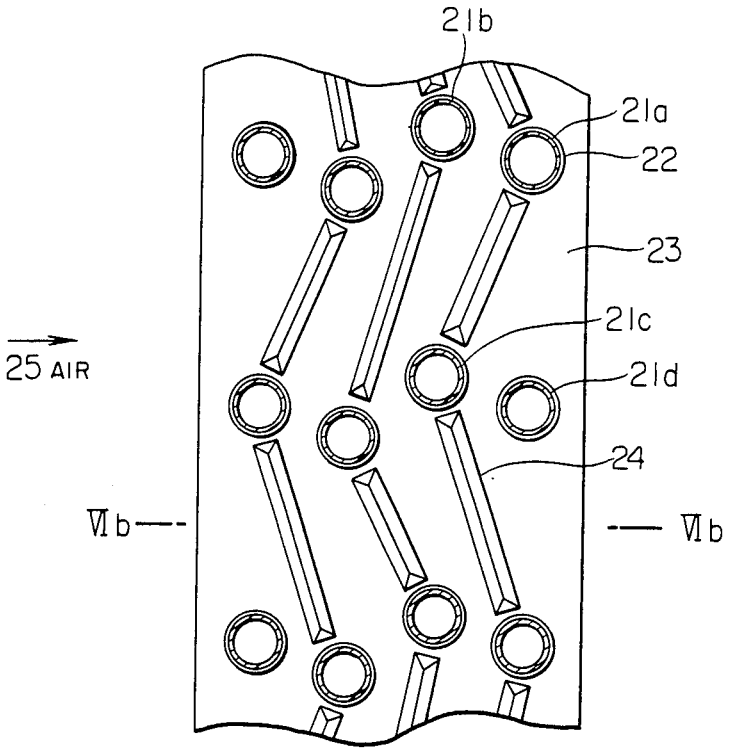
Figure 6B:
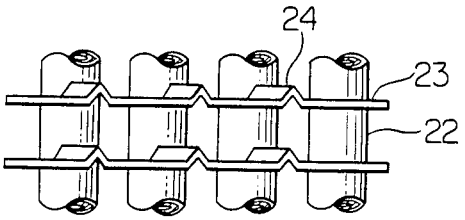

FIGS. 6*a* and 6*b* illustrate another embodiment of the present invention, in which FIG. 6*a* is a top plan view, while FIG. 6*b* is a cross-sectional view taken along the line VIb—VIb of FIG. 6*a*. The advantages of this embodiment are also substantially the same as those of the above-described two embodiments of the present invention but a difference lies in that linear protrusions 24 stretching between adjacent groups of copper tubes are provided. This linear protrusion is designed to facilitate the dropping of droplets of water at the time of dew-laden operation, to check the deterioration of the heat transfer rate resulting from a water screen as well as an increase in pressure loss, and to realize an evaporator fin having a low pressure loss and a high heat transfer rate. In this embodiment, the linear projection 24 is arranged such as to connect together, for instance, 21*a* and 21*c*, i.e., one copper tube and another which is located immediately upstream of an opposing copper tube in the adjacent group of copper tubes. However, this linear protrusion 24 may also be arranged perpendicularly to the direction of the air flow 25 in such a manner as to connect together the copper tube 21*a* and a copper tube 21*d*. In addition, this linear protrusion 24 has advantages of imparting turbulence to the air and of reducing the dead water region, and is capable of realizing a high heat transfer rate and a wide effective heat transfer area.

As is apparent from the foreging description, a heat exchanger according to the present invention has the following advantages: (1) Since the copper tubes in each group of copper tubes are disposed to be offset slightly with respect to each other in the direction perpendicular to the air flow, a horseshoe eddy generated due to the presence of an upstream-side copper tube and fins strikes against a downstream-side tube, thereby expanding a heat transfer area on the tube surface. (2) The aforementioned horseshoe eddy, which is generated from the upstream side, strikes against a tube surface, is branched to both sides of the tube, and reaches the rear portion of the tube in such a manner as to adhere to the tube, thereby reducing the area of the dead water region and increasing an effective heat transfer area. (3) The pressure loss is small since the pitch of the groups of copper tubes is greater than the pitch of the adjacent copper tubes. (4) Since the copper tubes in each group of copper tubes are arranged to be offset perpendicularly to the direction of the air flow, this arrangement allows a greater tube pitch than in the case where the tubes are arranged in a row in the direction of the air flow, and facilitates the dropping of droplets of water, when adhered, and the heat transfer performance is high during condensation. Because of these advantages, even if slits or the like are not provided on the fins, i.e., even in the case of flat fins, it becomes possible to realize a high heat transfer performance. For this reason, if this heat exchanger according to the present invention is applied to the outboard unit of a heat-pump heater, it is possible to realize a compact outboard unit with a long frosting time.

Figure 7A:
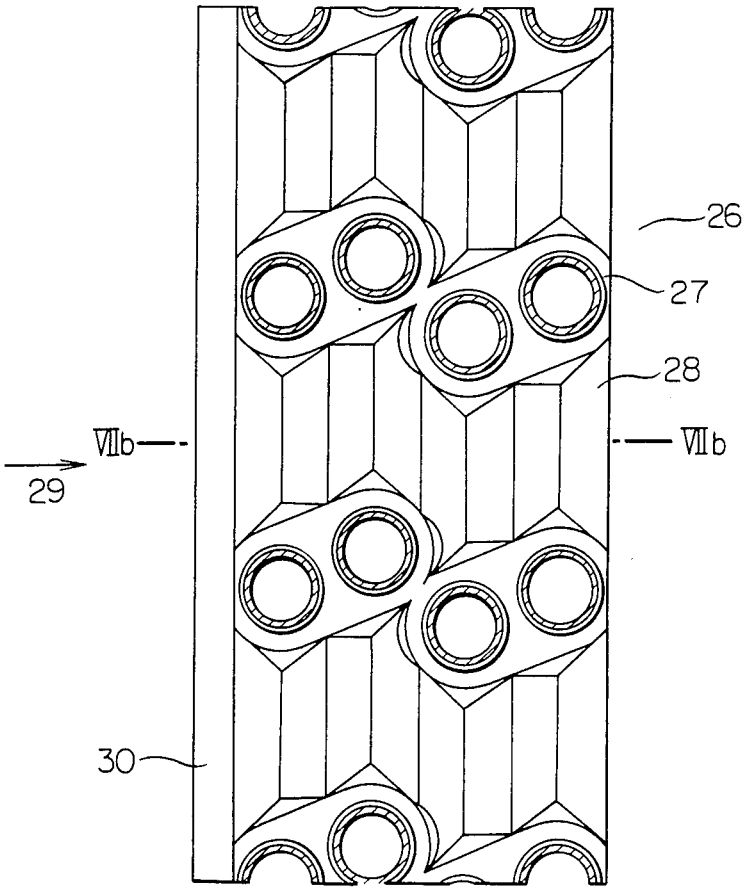
Figure 7B:
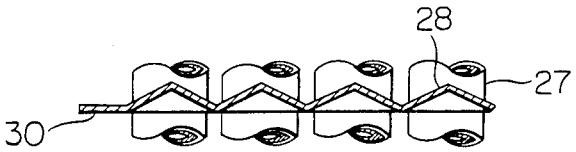

FIGS. 7*a* and 7*b* illustrate another embodiment of a heat exchanger according to the present invention, in which FIG. 7*a* is a top plan view, while FIG. 7*b* is a cross-sectional view taken along the line VIIb—VIIb of FIG. 7*a*. Reference numeral 26 denotes a copper tube; 27 a fin collar; and 28 a fin, the front end portion 30 of the fin 28 on the side of the air flow 29 being wider than the rear end portion thereof, as illustrated in the drawing. In addition, the fin 28 is arranged in a corrugated shape, as shown in FIG. 7*b*. The copper tubes 26 are arranged in such a manner that the projection area of any one of the upstream copper tubes partially overlaps the position of a downstream-side copper tube, as in the case of the aforementioned embodiments.

In addition to the advantages of the embodiment shown in FIGS. 7*a* and 7*b*, this embodiment has the following remarkable advantages: (1) since the front end of the fin is extended, the fin efficiency at the front end thereof becomes poor, which makes it possible to reduce the amount of condensation at the front end. For this reason, it becomes possible to operate the heat exchanger for a long time before it becomes blocked by the frosting at the front end. (2) Since the fin surface is arranged in a corrugated form, a horseshoe eddy generated by an upstream tube, when passing over the protrusion of the fin, strikes against a downstream tube while being discharged upwardly of the protrusion. As a result, the eddy is diffused, thereby improving the heat transfer rate and decreasing the area of the dead water region. (3) The air flows from the corrugated portion of the fin to the flat portion thereof in the periphery of the copper tube, and the secondary air flow occurs in the corrugated portion in the vicinity of a copper tube, thereby improving the heat transfer rate.

As described above, in this embodiment as well, it becomes possible to obtain a heat exchanger with remarkable improvements made in both the frosting characteristics and performance.

Referring now to FIGS. 9*a*, 9*b*, 10*a*, and 10*b*, description will be made of an embodiment of the present invention which is provided with slits.

Figure 9A:
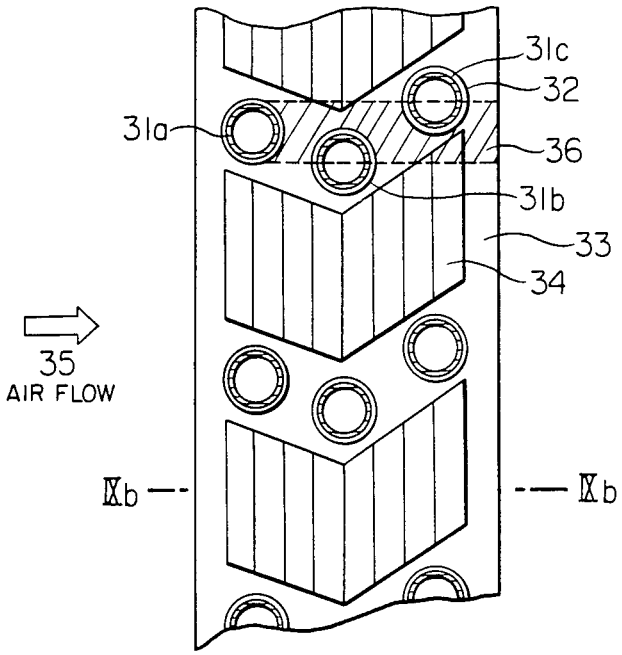
FIGS. 9*a*, 9*b*, 10*a*, and 10*b* schematically illustrate embodiments of a heat exchanger according to the present invention which are provided with slits.
Figure 9B:
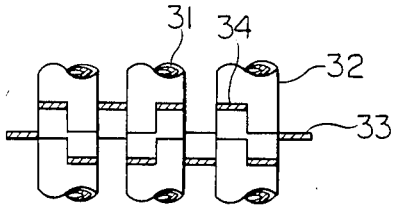

FIG. 9*a* is a top plan view of a heat exchanger having slits according to an embodiment of the present invention, while FIG. 9*b* is a cross-sectional view taken along the line IXb—IXb of FIG. 9*a*. Reference numerals 31*a*, 31*b*, and 31*c* denote copper tubes, around which fin collars 32 each provided with a bur are fitted, respectively. Reference numeral 33 denotes a fin, while numeral 34 denotes a bridge-like cutout. A refrigerant circulates through the copper tubes 31*a*, 31*b*, and 31*c*, and the heat of the refrigerant is transmitted to a copper tube 31, the fin collar 32, the fin 33, and then to the cutout 34. Meanwhile, the air flow 35 in the direction of the arrow, at the time of passing between the adjacent fins, indirectly exchanges heat transmitted from the refrigerant via the tube surface with which the air comes into contact.

The copper tubes 31*b* and 31*c* are disposed in such a manner that half portions thereof partially overlap the projection surface 36 (indicated by a shadowed portion) of the copper tube 31*a* disposed on the upstream side of the air flow. The air downstream of the copper tube 31*a* flows in such a manner as to enter the projection area 36 by virtue of these copper tubes 31*b*, 31*c*, so that the dead water region decreases remarkably. The position of the copper tube 31*c* can also be offset to the downstream side of the copper tube 31*b*, which does not contradict with the claims of the present invention. In this case, however, the advantage of reducing the area of the dead water region becomes less pronounced than in the case of this embodiment. In addition, although, in this embodiment, the projection areas of the copper tubes 31*b* and 31*c* are set to overlap each other by just one half of the copper tube diameter, but a similar effect can be obtained if the projection areas 36 partially overlap each other, as in the case of a heat exchanger which is not provided with slits. Although three copper tubes 31 are used in this embodiment, more than or less than three copper tubes 31 may be used.

In this embodiment, the cutouts 34 are provided in such a manner as to surround the copper tubes 31*a*, 31*b*, and 31*c* from both sides thereof, and the legs thereof connecting each cutout 34 with the fin 33 are disposed in such a manner as to be inclined with respect to the direction of the air flow 35. As a result, the legs function to induce the air flow into the region of the group of the copper tubes 31, thereby reducing the area of each dead water region. Moreover, since these legs are also disposed to be located in the area downstream of the copper tubes 31*a*, 31*b*, there are no of the flow rate of only some portion of the air being increased in the region of the group of copper tubes, and it hence becomes possible to obtain a uniform rate of air flow. In addition, the group of the copper tubes 31*a*, 31*b*, and 31*c* are generally aligned in a low, so that the heat flux between the adjacent groups of copper tubes is not impeded and the fin efficiency hence becomes high. For this reason, the overall heat transfer performance of the fin can be improved remarkably.

Next, description of another embodiment of the present invention will be made.

Figure 10A:
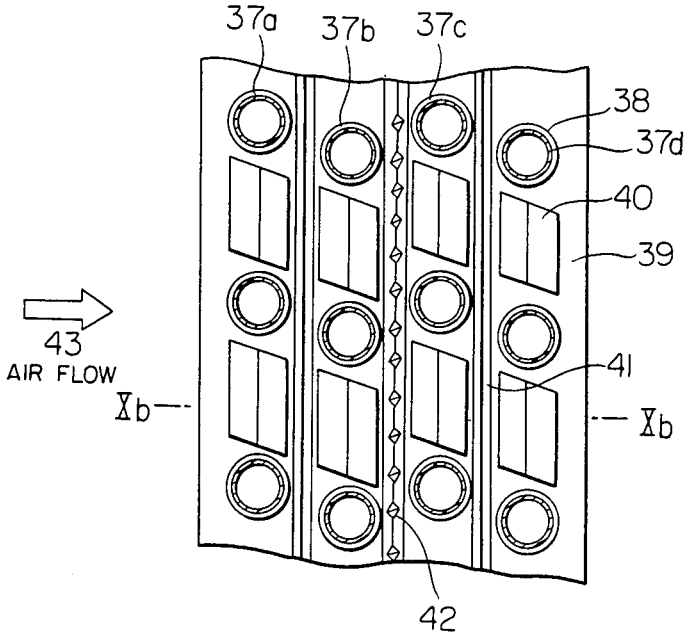
Figure 10B:
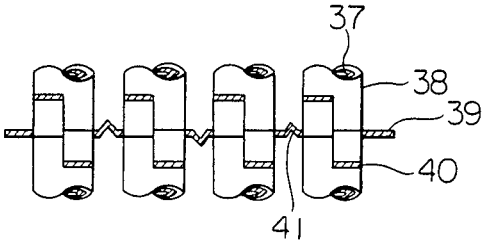

FIGS. 10*a* and 10*b* illustrate another embodiment of the present invention, in which FIG. 10*a* is a top plan view, while FIG. 10*b* is a cross-sectional view taken along the line Xb—Xb of FIG. 10*a*. Reference numerals 37*a*, 37*b*, 37*c*, and 37*d* denote copper tubes, respectively, and the copper tube 37*b* partially overlaps the projection area of the copper tube 37*a*. Similarly, the copper tube 37*c* partially overlaps the projection area of the copper tube 37*b*, while the copper tube 37*d* overlaps the projection area of the copper tube 37*c*. In this embodiment, the overlapping length is set to be one-half of the fin collar diameter. With respect to this value, most effective is one which falls within a range which is substantially equivalent to the range of values expressed in the embodiment of the present invention shown in FIG. 8. Meanwhile, reference numeral 38 denotes a fin collar which is made by burring a fin 39 and raising the burred portion. Reference numeral 40 denotes a bridge-like cutout of the fin 39. Ridge-like protrusions 41 are provided between the adjacent tubes 37 in such a manner as to cross the groups of copper tubes so as to agitate the air flow 43, and a plurality of indentations 42 are provided on the apex of some ridge-like protrusions 41. The bottom portion of each of these indentations is inclined with respect to the air flow. This causes the air flow to be mixed and a boundary layer to be agitated, so that it becomes possible to increase the heat transfer rate. In addition, if this heat exchanger is used as an evaporator, these ridge-like protrusions 41 has the advantages of not only agitating the air flow but also collecting condensed water. Consequently, the dropping of condensed water is effected speedily, thereby improving the heat transfer performance.

As described above, this embodiment has the following advantages: (1) The flow rate of the air flowing between the adjacent copper tubes is made uniform, and it thereby becomes possible to reduce the thermal resistance of the cutouts to a sufficiently low level. (2) The direction of the flow of air flowing downstream of a copper tube is changed by a downstream copper tube, and the air flows into the dead water region side. Hence, the area of a dead water region can be reduced, and an effective heat transfer area can thereby be increased. (3) Since the respective copper tubes are not disposed to be considerably offset as viewed in the direction of the air flow, the flow of heat from the copper tube to the fins and further to the cutouts is not impeded, thereby increasing the fin efficiency.

What is claimed is:

1. A heat exchanger, comprising: (a) a plurality of plate-shaped fins positioned in spaced parallel relationship with one another; and (b) a plurality of substantially parallel heat-transfer tubes intersecting said plurality of fins, said heat-transfer tubes being disposed in a plurality of non-linear rows oriented along a predetermined direction in a longitudinal dimension of said fins, said predetermined direction being adapted to correspond to a primary air flow direction of air passing between said fins, said fins including a plurality of cutouts opening toward said predetermined direction, said cutouts being provided between adjacent ones of said rows of heat-transfer tubes, a downstream-side projection area of each of said heat-transfer tubes located on an upstream side of said predetermined direction relative to said primary air flow direction partially overlaps the position of at least one of said heat-transfer tubes disposed on the downstream side of said predetermined direction, each of said cutouts being substantially channel-shaped and comprising two sides of cutting lines facing the air flow and two legs connecting each cutout with its associated fin, said two legs being inclined relative to said predetermined direction, a plurality of said channel-shaped cutouts being successively, discretely disposed and oriented in a slantwise direction relative to said predetermined direction in a repetitive pattern such that the legs of said respective cutouts are aligned along respective directions which extend generally parallel to a line connecting at least two adjacent heat transfer tubes in one of said rows of heat transfer tubes.

2. A heat exchanger according to claim 1, wherein the legs of said cutout connecting said fin are inclined with respect to the direction of said air flow.

* * * * *

UNITED STATES PATENT AND TRADEMARK OFFICE

CERTIFICATE OF CORRECTION

PATENT NO. : 4,715,437

DATED : December 29, 1987

INVENTOR(S) : Hiroyoshi TANAKA, et al

It is certified that error appears in the above-identified patent and that said Letters Patent is hereby corrected as shown below:

Title page, [73] Assignee should read --MATSUSHITA ELECTRIC INDUSTRIAL CO. Ltd., and MATSUSHITA REFRIGERATION COMPANY, Osaka, Japan

Signed and Sealed this

Twentieth Day of December, 1988

*Attest:*

DONALD J. QUIGG

*Attesting Officer*

*Commissioner of Patents and Trademarks*